US007894746B2

(12) United States Patent
Waugerman et al.

(10) Patent No.: US 7,894,746 B2
(45) Date of Patent: Feb. 22, 2011

(54) ELECTROPHOTOGRAPHIC DEVICE ARCHITECTURE FOR MEDIA OUTPUT OPTION USABILITY AND INTERCHANGEABILITY

(75) Inventors: Allen W. Waugerman, Lexington, NY (US); John E. Borsuk, Nicholasville, KY (US); Charles B Langrel, Lexington, KY (US); Gary E. Beglau, Lexington, KY (US); Jie Chan, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 512 days.

(21) Appl. No.: 11/954,642

(22) Filed: Dec. 12, 2007

(65) Prior Publication Data

US 2009/0154954 A1 Jun. 18, 2009

(51) Int. Cl.
*G03G 15/00* (2006.01)

(52) U.S. Cl. ..... 399/110; 399/407

(58) Field of Classification Search ..... 399/110, 399/124, 397, 403, 404, 405, 407, 408, 410
See application file for complete search history.

(56) References Cited

U.S. PATENT DOCUMENTS 6,134,418 A * 10/2000 Kato et al. ..... 399/405
6,233,427 B1 * 5/2001 Hirota et al. ..... 399/407
6,647,243 B2 * 11/2003 Sato et al. ..... 399/407
6,671,491 B1 * 12/2003 Yamanaka et al. ..... 399/407
6,671,492 B2 * 12/2003 Mimura et al. ..... 399/407
6,898,395 B2 * 5/2005 Mui et al. ..... 399/107
7,288,059 B2 * 10/2007 Ikeda et al. ..... 493/444
7,657,205 B2 * 2/2010 Kang ..... 399/110

* cited by examiner

*Primary Examiner*—Robert Beatty

(57) ABSTRACT

An electrophotographic device is provided for transferring a copy of an image from at least one first media sheet to at least one second media sheet. The device has a height, a width, and a depth defining a device external dimension, and also a width and depth defining a horizontal footprint of the device. The device includes a body adapted to receive therein at least one interchangeable media output module, which module when placed at a predetermined operating position is integrated into the path of travel of a media sheet passing through the device. A variety of interchangeable media output modules may be provided, including without limitation a multi-bin mailbox module, an automated media fastener module, an offset media stacker module, and combinations thereof. Advantageously, inclusion of one or more of the interchangeable media output modules does not alter the electrophotographic device external dimension and/or footprint.

18 Claims, 4 Drawing Sheets

ELECTROPHOTOGRAPHIC DEVICE ARCHITECTURE FOR MEDIA OUTPUT OPTION USABILITY AND INTERCHANGEABILITY

FIELD OF THE INVENTION

Generally, the present invention relates to electrophotographic devices, such as printers, multi-function printers (MFP's), all-in-one printers, copy machines, scanners, and the like. Particularly, it relates to a vertically stacked architecture for an electrophotographic device, for providing a range of media output option choices without increasing the device footprint and/or external dimension.

BACKGROUND OF THE INVENTION

As is well known in the art, electrophotographic devices such as printers, scanners, copy machines, and the like include a scanning unit for imaging an item to be scanned prior to transferring that image to, e.g., paper, transparencies, photographic paper, or a digital image storage means. A light source is provided in association with that scanning unit, which creates a light image of the media sheet to be scanned or copied. One or more media trays are also typically provided, for holding multiple sheets of a particular media onto which the image is to be transferred, such as paper, photographic paper, plastic or polymer transparency sheets, etc. A control panel, the appearance and design of which varies widely from device to device, is also provided to allow a user to input the desired commands to the device.

A typical electrophotographic device includes also one or more photoconductive members, such as a photoconductive drum or belt, which may be charged to a substantially uniform potential for transfer of a latent image thereto. Broadly, a conventional electrophotographic device exposes the photoconductive member to a light image of a document, drawing, or other image to be transferred to media, providing an electrostatic latent image of the document. The latent image is then developed by applying a developer such as a dry, granular toner, although a liquid developer may also be employed. The toner electrostatically adheres to the latent image, and is then transferred to a media sheet passed thereover. The toner may then be fused to the media sheet by application of heat. Of course, toner of one or more colors may be used, in accordance with the user's preference for a black-and-white only image or a color image.

Generally, electrophotographic devices of the type contemplated herein also desirably include one or more media output options, to which the media bearing the transferred image is delivered for retrieval by a user. Such output options may be the final stop in a media path defined by the path of travel of a sheet of media as it receives a copied image as discussed above. An output option may be as simple as a single tray to which all media sheets bearing the transferred image or images are delivered without further processing.

However, it is known also to provide more sophisticated media output options which present a finished product, that is one or more media sheets containing copied images. A non-limiting list of examples of such media output options may include a multi-bin "mailbox" output option, which segregates individual collated copies of a copied or scanned multi-page document in separate trays or bins after a copying or scanning action. Similarly, it is known to provide an automated fastener output option such as an automated stapler, for fastening multiple collated media sheets forming a single multi-page document. Still further, offset stacker output options are known, wherein collated media sheets forming multiple copies of a particular multi-page document are delivered to and vertically stacked in a single tray without fastening or segregating in different bins or trays, but wherein each copy of the multi-page document is slightly offset from both the preceding and the following copy for ease of retrieval. Such output options must be included as part of the path through which a media sheet travels from imaging to developing to fusing as discussed above, and are usually the final stop or endpoint of that media path of travel prior to retrieval by a user. That is, because a media sheet is a physical item traveling through a defined path of travel in an electrophotographic device, it is uncommon for media output options to be positioned remotely of the device.

The scanning unit, light source, photoconductive member, and media trays are typically considered essential components of an electrophotographic device. In other words, without at least those basic items, the electrophotographic device cannot perform its most basic function of transferring an image from one media sheet to one or more different media sheets. Accordingly, those items are typically provided internally of the electrophotographic device housing. Similarly, a source of toner or other developer is typically provided internally of the housing. That is, a particular "footprint" is defined by an external dimension of the electrophotographic device. That footprint determines the amount of horizontal space required to accommodate the device, and the items listed above are typically positioned within that footprint. Most commonly, a sheet feeder of the type noted above is positioned vertically atop a lid placed directly above the scanning unit contact glass, and therefore also does not extend outside of the device footprint.

Typically, media output options such as those described herein are provided as "add-ons" attached to the electrophotographic device, and as noted above typically form an endpoint of the media path of travel through the device. Most commonly, output options such as a mailbox, an offset stacker, and the like must be physically attached to one side of the electrophotographic device or to the front of the device to allow them to integrate into the media path of travel, and therefore extend beyond the device footprint. Undesirably, this increases the space required for the electrophotographic device, which space may be at a premium. Still further, because of the limited space available for placing output options on the side or front of the typical electrophotographic device, often the customer must elect a particular set of output options at the time of acquiring the device. The user may not be able to conveniently reconfigure the electrographic device to include additional output options without removing existing output options, due to considerations of available space on the device.

Accordingly, a need is identified in the art for an electrophotographic device providing a range of media output options, wherein the output options do not increase the device footprint and/or external dimension. Desirably, a plurality of such output options will be provided and made interchangeable within the electrophotographic device. In this manner, the user need not be restricted to a particular set of options, but may reconfigure the device output options as needed in accordance with the preferred media output desired for a particular job.

SUMMARY OF THE INVENTION

The above-mentioned and other problems become solved by applying the principles and teachings associated with the presently described electrophotographic device. In its most basic sense, the present device comprises one or more removable, interchangeable media output modules. A device body includes a receiver for receiving one or more interchangeable media output modules, singly or in combination.

Still further, the electrophotographic device body can receive therein at least one interchangeable media output option module, including without limitation finishing options such as a multi-bin mailbox sorter, an automated media fastener such as a stapler, an offset media stacker, and the like. The device body is adapted to receive one or more such media output modules, whereby a horizontal footprint and/or external dimension of the device are not altered, such as by a portion of the module extending outside of that footprint and/or external dimension. The media output modules, when placed in the receiver in an operating position, are integrated into the device media path. Advantageously, this electrophotographic device allows the user to customize and reconfigure the device in accordance with personal preference and the requirements of a particular scanning or copying job, without altering of the electrophotographic device footprint or external dimension.

These and other embodiments, aspects, advantages, and features of the present invention will be set forth in the description which follows, and in part will become apparent to those of ordinary skill in the art by reference to the following description of the invention and referenced drawings or by practice of the invention. The aspects, advantages, and features of the invention are realized and attained by means of the instrumentalities, procedures, and combinations particularly pointed out in the appended claims.

BRIEF DESCRIPTION OF THE DRAWINGS

The accompanying drawings incorporated in and forming a part of the specification, illustrate several aspects of the present invention, and together with the description serve to explain the principles of the invention. In the drawings.

DETAILED DESCRIPTION OF THE ILLUSTRATED EMBODIMENTS

In the following detailed description of the illustrated embodiments, reference is made to the accompanying drawings that form a part hereof, and in which is shown by way of illustration, specific embodiments in which the invention may be practiced. These embodiments are described in sufficient detail to enable those skilled in the art to practice the invention and like numerals represent like details in the various figures. Also, it is to be understood that other embodiments may be utilized and that process, mechanical, electrical, software, and/or other changes may be made without departing from the scope of the present invention.

In accordance with the foregoing identified need in the art, an electrophotographic device 10 for transferring a copy of an image from at least one first media sheet to at least one second media sheet is provided. That device 10 comprises a defined external dimension, and is adapted to receive therein at least one modular interchangeable media output option, including without limitation finishing options such as a mailbox sorter, an automated media fastener such as a stapler, an offset media stacker, and the like. Advantageously, when the interchangeable media output module is installed in the housing, the device external dimension is not increased. Similarly, the device footprint, that is the horizontal area occupied by the electrophotographic device 10, is not altered by inclusion of the one or more interchangeable media output modules.

Further, the device user is not limited to the physical space available on the front, side, or top of the electrophotographic device 10 in terms of the number of media output options which may be included in or on the device, but need only remove a presently undesired option and replace it with a desired one. The skilled artisan will readily appreciate the advantage this feature provides over conventional electrophotographic devices, wherein front, side, or top installation of one or more media output options requires increasing the device footprint and/or external dimension, and further wherein the space available for including such options is limited by the physical space provided on at least the sides, front, and back of the device.

Figure 1:
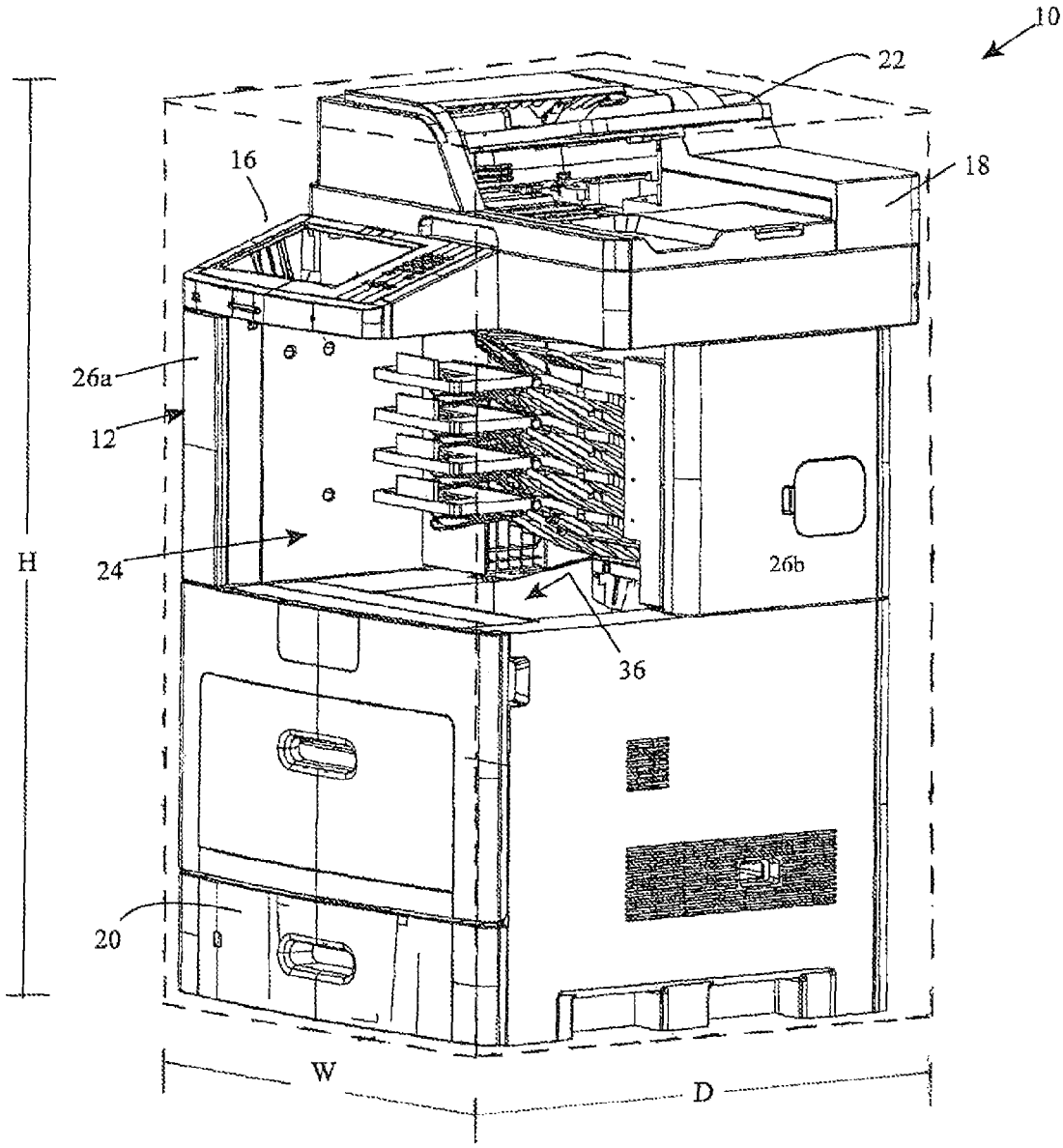
FIG. 1 shows an electrophotographic device including an interchangeable media output option installed therein.

Turning now to FIG. 1, there is depicted a representative electrophotographic device 10 for transferring a copy of an image from at least one first media sheet to at least one second media sheet. The device 10 has a height H, a width W, and a depth D which in combination define an external dimension of the device 10, that is, a space occupied by the device 10 beyond which no portion of the device 10 extends. That external dimension may be conceptualized as an imaginary three-dimensional boundary, shown in FIG. 1 in dotted lines, beyond which no portion of the device 10 extends.

The device 10 includes a body 12, adapted to receive therein at least one interchangeable media output module 14. As can be seen in the appended Figures, and as will be described in greater detail below, incorporating the interchangeable media output module 14 into the device 10 body 12 does not alter the external dimension. That is, an interchangeable media output module 14 included with device 10 will not extend beyond the device 10 external dimension depicted in broken lines in FIG. 1.

The electrophotographic device 10 includes features well-known in the art, such as a control panel 16 for receiving input instructions from a user, a scanning unit 18 which scans a document containing text and/or images to be copied, and at least one media tray 20 for holding one or more media sheets onto which the text and/or images are to be copied. Such media sheets may include without limitation paper, photographic paper, transparencies, and the like. A top-mounted media sheet feeder 22 may also be provided.

The device 10 has a width W and a depth D which substantially define a horizontal footprint of the device 10. When viewing the device 10 from the top, the horizontal footprint may be conceptualized as an imaginary two-dimensional boundary defining the amount of horizontal area required to accommodate the device 10 thereon, beyond which no portion of the device 10 extends horizontally. At least one removable and interchangeable media output module 14 is provided, in the depicted embodiment being a multi-bin mailbox sorter option. Representative interchangeable media output modules 14 contemplated for use in the present invention include without limitation multi-bin mailbox modules, automated media fastener modules such as automated staplers, and offset media stacker modules. As can be seen from FIG. 1, the control panel 16, scanning unit 18, at least one media tray 20, and at least one media output module 14 do not extend beyond the device 10 horizontal footprint.

The electrophotographic device 10 body 12 includes an open receiver 24, vertically positioned below the scanning unit 18. That receiver 24 is defined by left and right supports 26*a*, 26*b*. Supports 26*a*, 26*b* may be solid, or may be hollow to accommodate and hide wiring, cabling, or other elements of the electrophotographic device 10 mechanism. When placed in a predetermined operating position, the at least one interchangeable media output module 14 is vertically stacked below the scanning unit 18, and is typically dimensioned to be fully enclosed in receiver 24. It will be appreciated that even the empty portions of open receiver 24, as well as the left and right supports 26*a*, 26*b*, are contained within the device 10 external dimension and horizontal footprint. Accordingly, inclusion of an interchangeable media output module 14 in receiver 24 of electrophotographic device 10 also does not alter an external dimension of the device 10, defined as described above by a height H, width W, and depth D of the device 10, in addition to not altering the horizontal footprint defined by width W and depth D.

A representative interchangeable media output module 14 is shown in FIG. 3, in that embodiment again being a multi-bin mailbox sorter. It will be noted that in the view depicted in FIG. 3, the right support 26*b* is removed for convenience of viewing. A pair of prongs 28*a*, 28*b* are provided at a lower surface 30 of the module 14. A pair of cooperating stops 32*a*, 32*b* are provided in top surfaces 34 of receiver 24 proximal to ramped or inclined portions of the to surfaces 34, which operate to which prevent the user from advancing the interchangeable media output module 14 beyond a predetermined operating position (shown representatively in FIGS. 1 and 2). Optionally, wheels 36*a*, 36*b* may be provided at lower surface 30 of the module 14, to reduce frictional resistance during passage of interchangeable media output module 14 into or out of receiver 24 in the directions represented by arrow A. In the embodiment depicted herein, wheels 36*a*, 36*b* nest into cooperating stops 32*a*, 32*b*, respectively to prevent the user from advancing interchangeable media output module 14 past the predetermined operating position.

Figure 2:
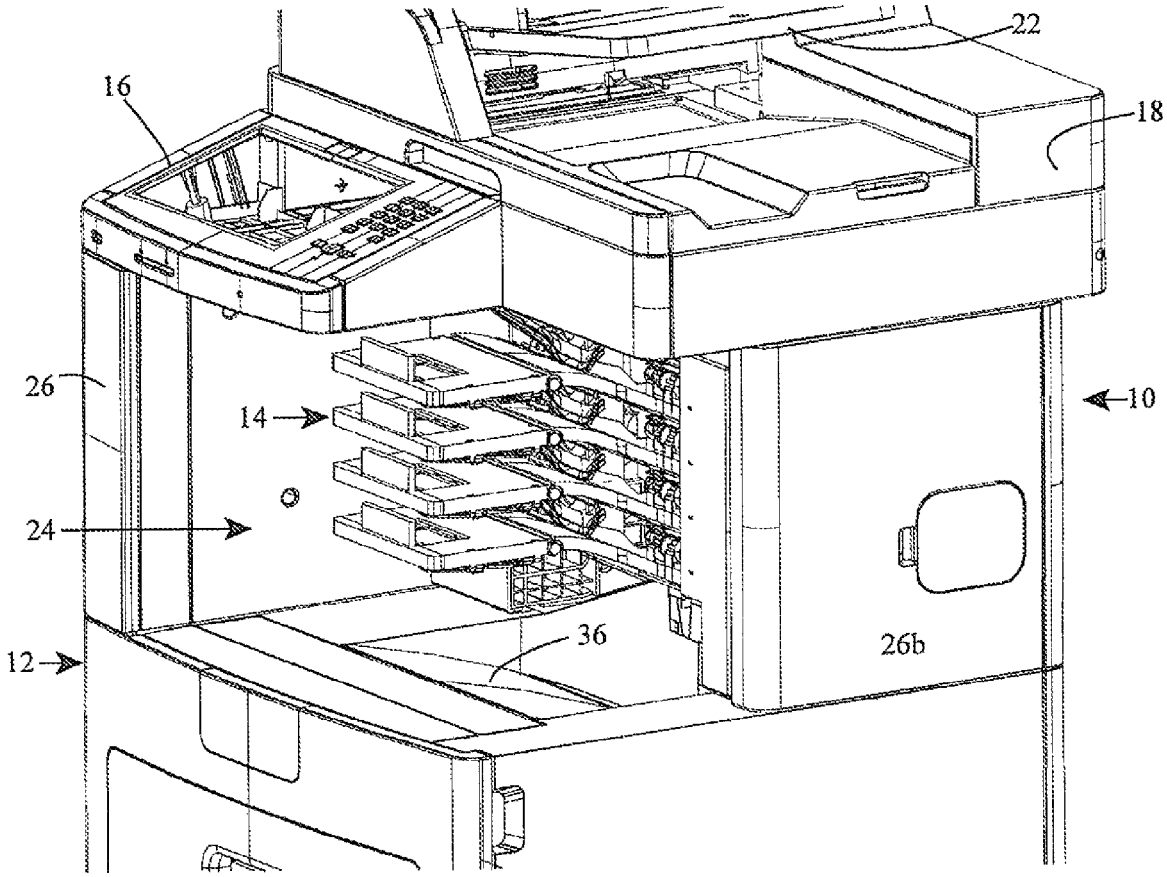
FIG. 2 is a perspective view of the device of FIG. 1.
Figure 3:
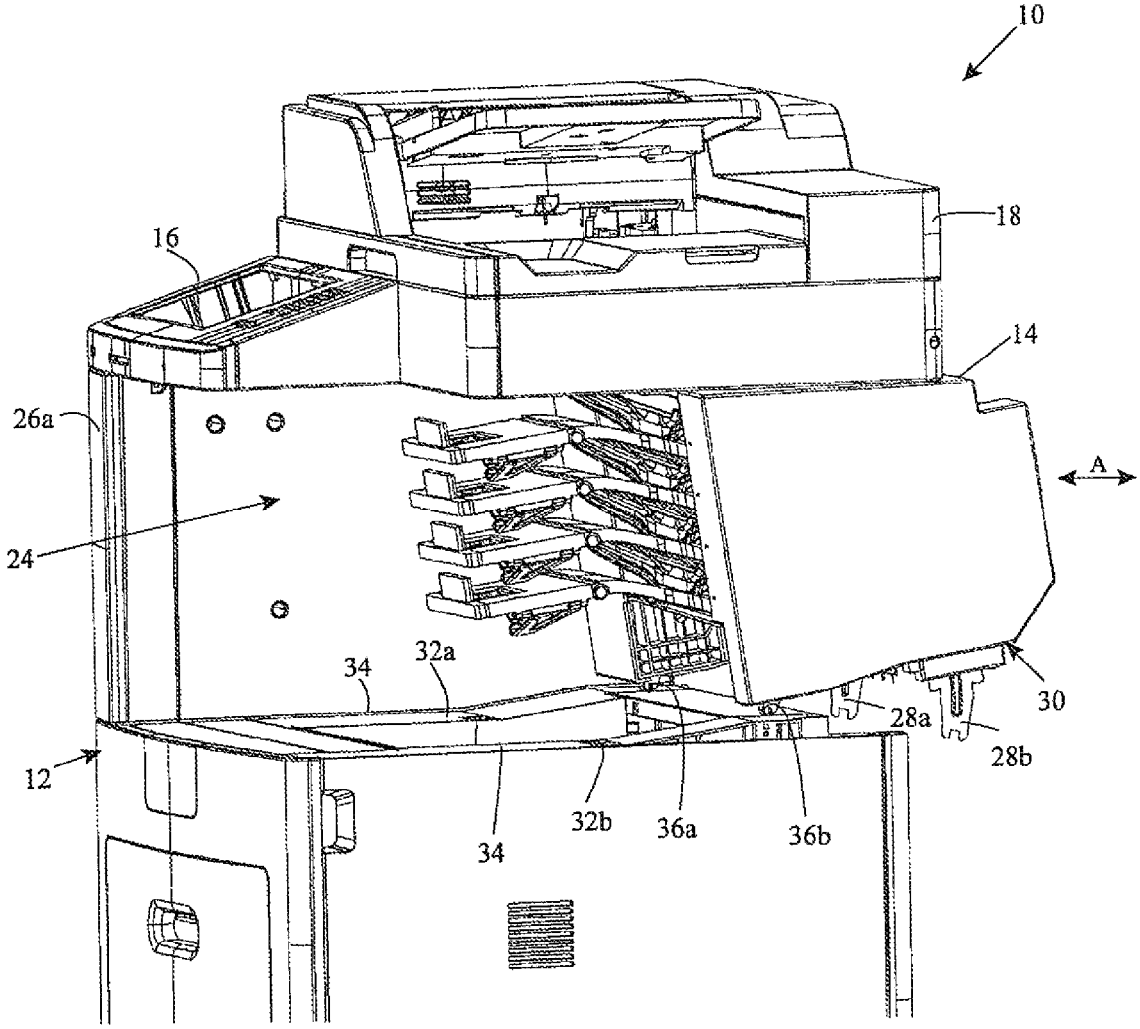
FIG. 3 shows insertion of an interchangeable media output option into an electrophotographic device.

When interchangeable media output module 14 is placed in the predetermined operating position as shown in FIGS. 1 and 2, prongs 28*a*, 28*b* place the module 14 in electrical communication with the electrophotographic device 10. This provides an "autoconnect" functionality, providing a means for the interchangeable media output module 14 to communicate with the device 10, eliminating any need for additional cabling or wiring to supply power and/or communication means to the module 14.

Figure 4:
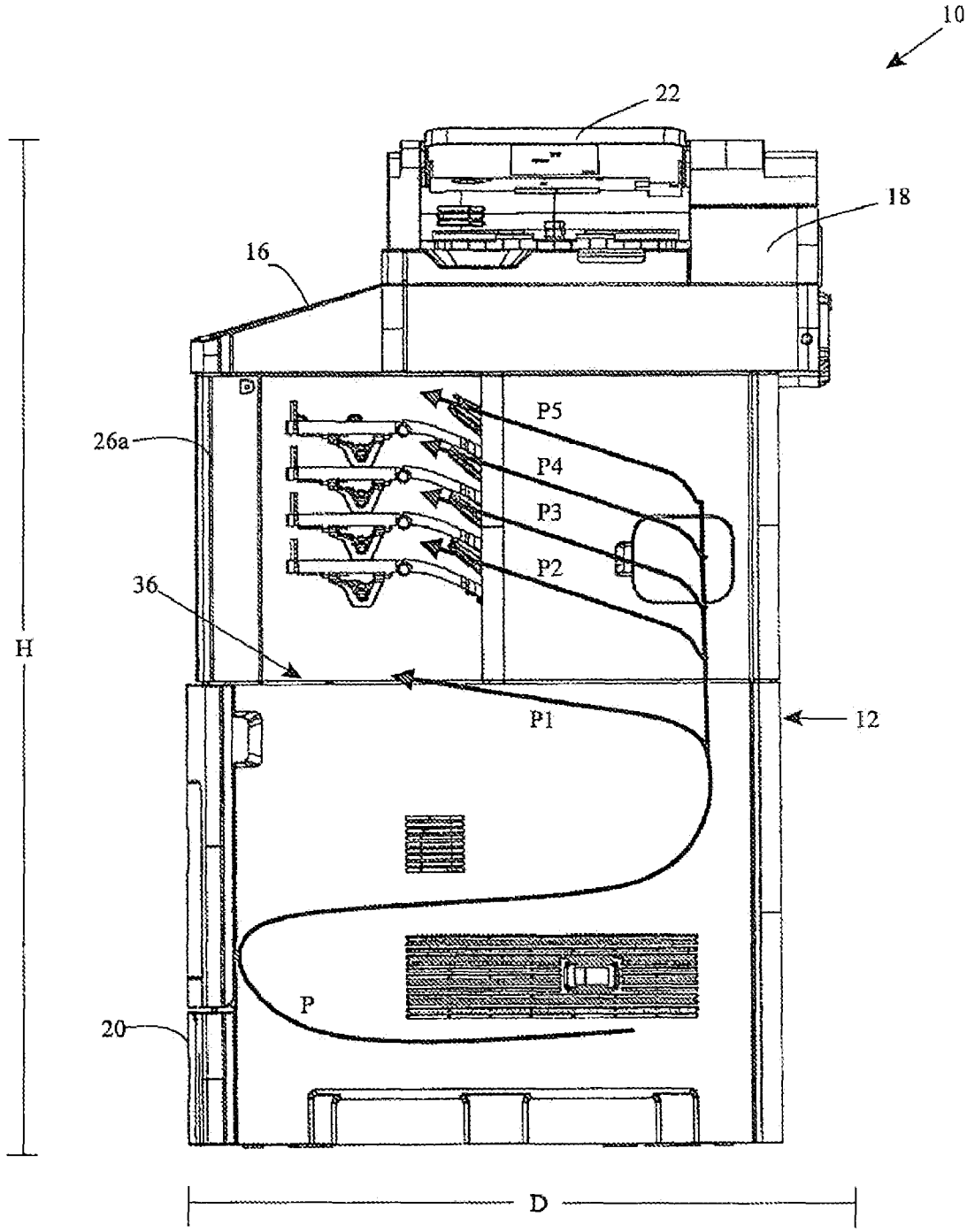
FIG. 4 schematically depicts a path of travel for media sheets passing through the device of FIG. 1 for outputting at the interchangeable media output option.

As is known in the art and discussed briefly above, media sheets (not shown for convenience) onto which an image is to be copied generally pass through an electrophotographic device 10 via a defined path of travel P. With reference to FIG. 4, representatively, the media sheets may be transferred from a media tray 20 to one or more internal areas of the device 10 wherein the processes of image transfer, toner application, toner fusion, and other imaging and finishing processes are performed. After the final step of image transfer, the media sheets are passed to a final output option, which may be as simple as an output tray 36 as shown in FIG. 4. That path of travel is schematically depicted as P1, in the depicted embodiment providing the general form of an S (a reverse S when the device 10 is oriented as shown in the Figures). For the present device 10, the media sheet may be transferred to output tray 36 when no interchangeable media output module 14 is present.

In use, positioning the at least one interchangeable media output module 14 (in the depicted embodiment a multi-bin mailbox sorter) in the receiver 24 at the predetermined operating position integrates the module 14 into the path of travel P of the media sheet passing through the device 10. That is, when the module 14 is installed as described above, rather than simply outputting to output tray 36 via path P1, the media sheets are directed to the module 14 for further processing and outputting via one or more of paths P2, P3, P4, P5, and are output to a front of the device 10 for user convenience. That function may be automatic and engaged upon positioning interchangeable media output module 14 properly in receiver 24, or may require a specific command input from a user.

Of course, receiver 24 may be adapted to hold one or more interchangeable media output modules 14. For example, it may be desirable to include in combination a multi-bin mailbox sorter and an automated fastener such as an automated stapler, whereby individual collated copies of a copied or scanned multi-page document are fastened prior to dispensing into separate trays by one or more of paths P2, P3, P4, and P5.

Accordingly, an electrophotographic device 10 including one or more interchangeable media output modules 14 is described herein. Conventional electrophotographic devices provide only a limited physical space for attachment of such devices, and the user may therefore be forced to choose particular media output options, and may not be able to conveniently change the options available to meet changing media output needs. Advantageously, the device 10 described herein allows convenient user reconfiguration to provide any number of media output options in a single electrophotographic device 10, such as automated fastening, mailbox sorting, offset stacking, and the like alone and in combination, all without increasing the device 10 footprint or external dimension.

One of ordinary skill in the art will recognize that additional embodiments of the invention are also possible without departing from the teachings herein. This detailed description, and particularly the specific details of the exemplary embodiments, is given primarily for clarity of understanding, and no unnecessary limitations are to be imported, for modifications will become obvious to those skilled in the art upon reading this disclosure and may be made without departing from the spirit or scope of the invention. Relatively apparent modifications, of course, include combining the various features of one or more figures with the features of one or more of other figures.

The invention claimed is:

1. An electrophotographic device for transferring a copy of an image to at least one media sheet, comprising a body having a receiver and at least one interchangeable media output module, the receiver being adapted to receive therein the at least one interchangeable media output module, the receiver including a plurality of surfaces, each surface including a stop, and the at least one interchangeable media output module including a plurality of wheel members for inserting the at least one interchangeable media output module within the receiver, the wheel members engaging with surfaces during insertion and with the stops when the at least one interchangeable media output module is in an predetermined operating position within the receiver, whereby the interchangeable media output module does not increase an external dimension of the device.

2. The device of claim 1, wherein positioning the at least one interchangeable media output module in the receiver at the predetermined operating position integrates the module into a path of travel of a media sheet passing through the device.

3. The device of claim 2, wherein the one or more interchangeable media output modules are selected from the group consisting of a multi-bin mailbox module, an automated media fastener module, an offset media stacker module, and combinations thereof.

4. The device of claim 3, wherein the one or more interchangeable media output modules, when received in the receiver, are vertically positioned below a device scanning unit.

5. The device of claim 4, wherein the one or more interchangeable media output modules, when received in the receiver at the predetermined operating position, are also placed in electrical communication with the electrophotographic device.

6. The device of claim 1, wherein each of the surfaces of the receiver includes a ramped portion that is inclined relative to a horizontal line, and each stop is disposed at a lowest end of a corresponding ramped portion.

7. The device of claim 1, wherein the at least one interchangeable media output module includes a housing, wherein the plurality of wheel members are disposed along a bottom portion of the housing proximal to a first side thereof, and the at least one interchangeable media output module includes one or more prongs disposed along the bottom portion of the housing proximal to a second side thereof, the one or more prongs forming one or more electrical connectors for the media output module.

8. An electrophotographic device for transferring a copy of an image to at least one media sheet, comprising:

a control panel for receiving input instructions from a user;

a scanning unit;

at least one media tray for holding one or more media sheets onto which an image copy is to be transferred;

a body having a plurality of elongated surface members, each elongated surface member having a ramp portion; and at least one removable and interchangeable media output module which engages with the ramp portion of the elongated surface members when inserted within the body;

said device having a width and a depth defining a horizontal footprint of the device wherein the control panel, scanning unit, at least one media tray, body, and at least one media output module do not extend beyond the horizontal footprint.

9. The device of claim 8, wherein the at least one media output module includes a plurality of wheel members which extend from a bottom portion thereof, the wheel members engaging with the ramp portions of the elongated surface members during insertion of the at least one media output module within the body.

10. The device of claim 9, wherein each elongated surface member includes a stop portion positioned proximally to a corresponding ramp portion such that a corresponding wheel member engages with the stop portion when the at least one media output module is in an operating position within the body.

11. The device of claim 10, wherein positioning the at least one interchangeable media output module in the receiver at the operating position integrates the module into a path of travel of a media sheet passing through the device.

12. The device of claim 11, wherein the at least one interchangeable media output module is one or more of a multi-bin mailbox module, an automated media fastener module, or an offset media stacker module.

13. The device of claim 10, wherein the at least one interchangeable media output module includes at least one prong for placing the at least one interchangeable media output module in electrical communication with the electrophotographic device.

14. An electrophotographic device for transferring a copy of an image to at least one media sheet, comprising:

a body;

a control panel for receiving input instructions from a user;

a scanning unit;

at least one media tray for holding one or more media sheets onto which an image copy is to be transferred;

a receiver defined within the body; and at least one media output module having a plurality of wheel members disposed proximal to a first end portion thereof for rolling the at least one module within the receiver, and one or more prong members disposed proximal to and extending downwardly from a second end portion of the at least one media output module opposite the first end thereof, the one or more prong members providing an electrical connection between the at least one interchangeable media output module and the electrophotographic device;

wherein the control panel, scanning unit, at least one media tray, body, and the at least one media output module when received in the receiver do not increase a device external dimension defined by a device height, a device width, and a device depth.

15. The device of claim 14, wherein the receiver is vertically positioned below the scanning unit.

16. The device of claim 15, wherein the at least one interchangeable media output module is one or more of a multi-bin mailbox module, an automated media fastener module, and an offset media stacker module.

17. The device of claim 16, wherein the at least one interchangeable media output module, when positioned in the receiver at a predetermined operating position, is integrated into a path of travel of a media sheet passing through the device.

18. The device of claim 17, wherein the receiver includes at least one stop for positioning the at least one interchangeable media output module at the predetermined operating position in the receiver.

* * * * *